US006447410B2

(12) United States Patent
Crawford

(10) Patent No.: US 6,447,410 B2
(45) **Date of Patent: *Sep. 10, 2002**

(54) LACROSSE STICK POCKET SHOOTING STRINGS AND THONG ELEMENTS

(75) Inventor: William C. Crawford, Baltimore, MD (US)

(73) Assignee: STX LLC, Baltimore, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/443,703

(22) Filed: Nov. 19, 1999

(51) Int. Cl.[7] ..... A63B 59/02; A63B 65/12
(52) U.S. Cl. ..... 473/513; 473/543
(58) Field of Search ..... 473/513, 543, 473/516, 539, 548

(56) References Cited

U.S. PATENT DOCUMENTS

| | | | | | |
|---|---|---|---|---|---|
| 1,279,719 | A | * | 9/1918 | Lewis | 473/453 |
| 1,279,720 | A | * | 9/1918 | Lewis | 473/543 |
| 4,034,984 | A | | 7/1977 | Crawford et al. | |
| 4,049,273 | A | * | 9/1977 | Poole | 473/513 |
| 4,273,331 | A | * | 6/1981 | Fischer | 473/543 |
| 4,458,898 | A | * | 7/1984 | Boden | 473/543 |
| 4,460,178 | A | * | 7/1984 | Ulman | 473/513 |
| 5,158,286 | A | * | 10/1992 | Soong | 473/522 |
| 5,707,306 | A | * | 1/1998 | Boden | 473/543 |
| 5,840,633 | A | | 11/1998 | Kurihara et al. | |

OTHER PUBLICATIONS

Shooting strings www.e–lacrosse.com/stech24.html pp. 1–8, Oct. 2000.*
Table of contents www.e–lacrosse.com/stech.html pp. 1–2, Oct. 2000.*
Readers tips Vi www.e–lacrosse.com/stech18.html pp. 1–4, May 2000.*
The mesh chronicles www.e–lacrosse.com/stech14.html pp. 1–8, Dec. 1999.*
The dog track or pita pocket www.e–lacrosse.com/stech3.html pp. 1–5, Sep. 1998.*
The search for the perfect Pocket www.e–lacrosse.com/stech2.html pp. 1–6, Aug. 1998.*
Brine, Inc. Catalog, SureShot pocket, p. 5 (1999).

* cited by examiner

*Primary Examiner*—Paul T. Sewell
*Assistant Examiner*—M. Chambers
(74) *Attorney, Agent, or Firm*—Connolly Bove Lodge & Hutz LLP

(57) ABSTRACT

A head for a lacrosse stick that includes a web for receiving a ball, the web being attached to a frame member of the head, and one or more tube-like woven or non-woven polymer shooting string elements extending transversely between side walls of the frame member and through the frame member, to facilitate pocket adjustment. The head may also include one or more tube-like woven or non-woven polymer thong elements extending longitudinally between the scoop and the stop of the frame member.

8 Claims, 3 Drawing Sheets

Fig.1B.
(PriorArt)
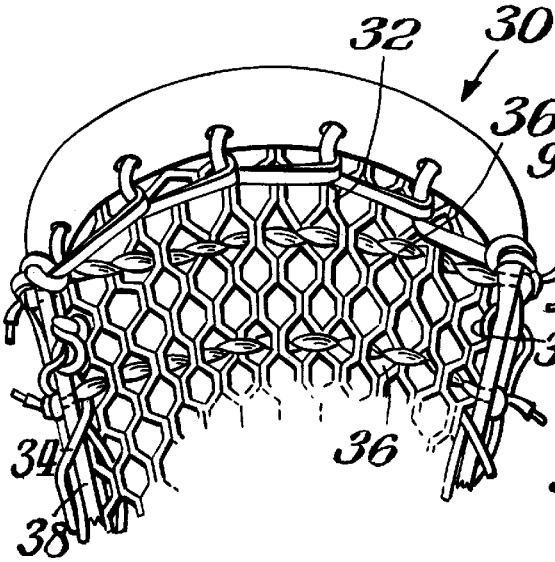

LACROSSE STICK POCKET SHOOTING STRINGS AND THONG ELEMENTS

BACKGROUND OF THE INVENTION

A. Field of the Invention

The present invention relates generally to lacrosse sticks and, more particularly, to shooting string and thong elements used in a lacrosse stick pocket.

B. Description of the Related Art

As shown in FIG. 1A, a traditional lacrosse stick stringing assembly configuration 10 usually comprises four longitudinal leather thong elements 12 which extend between respective apertures 22 defined in the part of a head of a lacrosse stick known as the scoop 16, and the base of the head adjacent to the part of a lacrosse head known as the stop 23. Each leather thong element 12 comprises one or more vertical slits 20 for attaching leather thong element 12 in an aperture 22 provided in scoop 16 of the head. An open weave cross lacing 14 extends transversely to interconnect leather thong elements 12 to the head frame and maintain the same in a predetermined space relation. Open weave cross lacing 14 wraps around leather thong elements 12 in certain sections, but may also extend through vertical slits provided in leather thong elements 12. The overall assembly thus forms what is referred to as a traditionally strung pocket for catching, carrying and throwing the lacrosse ball.

Another lacrosse stick stringing configuration known in the art is the mesh configuration. Rather than the longitudinal thongs and open weave lacing of the traditional lacrosse stick stringing configuration, the mesh configuration employs a mesh knitted as a continuous strip of woven material (see FIG. 1B) having a plurality of openings or "mesh diamonds" provided therein. The mesh is peripherally coupled to the head of the lacrosse stick by multiple stringing cords or other binding materials. Still another conventional stringing configuration 30, as shown in FIG. 1B, includes a central mesh portion 32 and open weave lacing 34 interconnecting mesh portion 32 to side walls 38 of the head frame. This configuration provides sufficient flexibility to a central portion of the pocket, facilitating formation of a suitable ball pocket due to the relatively non-deformable open weave lacings.

In all conventional stringing configurations, transverse lacing 26 (in FIG. 1A), 36 (in FIG. 1B), also known as "throwstrings" or "shooting strings," is further provided adjacent the scoop of the lacrosse stick head. Conventional shooting strings are made from cord, shoe-lace or other string-like material, including woven synthetic materials such as nylon, and are interwoven among the pocket lacing and leather thongs or in between the mesh diamonds. In addition to supporting the pocket stringing, the shooting strings prevent the thrown ball from traveling too far up the pocket assembly and striking the scoop area of the head. A ball striking the scoop area causes inaccurate passing and shooting of the ball. Thus, shooting strings are designed to be the point of departure of a thrown ball, facilitating accurate passing and shooting. Players use one or more shooting strings in a variety of locations and positions in the pocket in an effort to fine-tune and adjust their pocket to suit their style of play regarding catching, cradling and throwing the ball. These same shooting string materials may be interwoven among the pocket lacing and leather thongs or in between the mesh diamonds in the pocket from sidewall to sidewall in an arc-like or upside down V or U-shape, enhancing pocket formation and ball location, and creating a channeling-like effect when the ball is cradled, carried or thrown.

Unfortunately, traditional shooting string and thong element materials rot, break, crack, wear out, absorb water, and stretch due to weather conditions and the constant wear and tear of catching and throwing a lacrosse ball. Also, the surface of traditional shooting strings that makes contact with lacrosse ball provides little consistency or design variability to the pocket, such surface being randomly determined by the mesh diamond-like designs or the traditional leather thong elements and open weave cross lacing through which shooting strings have been interwoven. In addition, traditional shooting strings and longitudinal thongs are not easy to adjust since they require loosening of knots made to hold them in place and a tedious adjustment process along the parts of the shooting string and thong that are interwoven among the pocket lacing or mesh diamonds.

SUMMARY OF THE INVENTION

An object of the invention is to provide flexible, tube-like polymer shooting string and thong elements for a lacrosse stick that overcome the problems of the related art by virtue of their adjustability, consistency, durability and varied properties.

A further object of the present invention is to provide flexible, tube-like polymer shooting string and thong elements for a lacrosse stick that are easily interwoven with either mesh or traditionally strung pockets.

A still further object of the present invention is to provide flexible, tube-like polymer shooting string and thong elements for a lacrosse stick that are lightweight and water resistant, enhance lacrosse ball catching and throwing, and provide greatly improved abrasion-resistant qualities.

Another object of the present invention is to provide flexible, tube-like polymer shooting string and thong elements for a lacrosse stick that offer a player more options to fine tune the pocket and prevent undesirable slipping of the open weave cross lacing design, sometimes referred to as "diamonds" by those skilled in the art.

Still another object of the present invention is to provide flexible, tube-like polymer shooting string and thong elements that allow a player more easily to control the depth of the pocket, permitting custom pocket choices not available with traditional shooting strings and thongs.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a head for a lacrosse stick, having: a frame member having first and second side walls, each of the side walls having a proximal end and a distal end, the frame member further having a scoop extending between the distal ends of the side walls, and a stop extending between the proximal ends of the side walls; a web for receiving a ball, the web being attached to the frame member; and one or more tube-like polymer elements extending transversely and/or longitudinally within the frame member.

To further achieve the objects, the present invention comprises a head for a lacrosse stick, having: a frame member having first and second side walls, each of the side walls having a proximal end and a distal end, the frame member further having a scoop extending between the distal ends of the side walls, and a stop extending between the proximal ends of the side walls; a web for receiving a ball, the web being attached to the frame member; and one or more polyurethane cords extending transversely and/or longitudinally within the frame member.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings:

FIG. 1B is a fragmental top plan view of a lacrosse stick head having conventional mesh web configuration and shooting string elements;

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts. All of the figures show directional arrows, wherein a longitudinal direction corresponds to the vertical direction and a transverse direction corresponds to the horizontal direction.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "non-woven polymer" means a polymer having a structure of individual fibers or threads which are interlaid, but not in an identifiable manner. Whereas the term "woven polymer" means a polymer having a structure of individual fibers or threads which are interlaid in an identifiable manner or pattern.

As used herein, the term "synthetic polymer" means a polymer that is artificially created and not found in nature. Whereas the term "natural polymer" is defined as a polymer found in nature, such as silk, wool, and cellulose, by way of illustration only.

As used herein, the term "sidestrings" means the material that attach a lacrosse stringing assembly to the sidewalls of the lacrosse head. Sidestrings typically are made from a string-like material, such as a shoelace, that tie the stringing assembly to the sidewalls.

In accordance with the invention, the present invention is drawn generally to a head for a lacrosse stick. The head preferably includes a frame member having first and second side walls, each of the side walls having a proximal end and a distal end. The frame member further includes a transverse wall or scoop extending between the distal ends of the side walls, and an end wall or a stop extending between the proximal ends of the side walls. The head further preferably comprises a web for receiving a ball, the web being attached to the frame member, and at least one flexible, tube-like polymer shooting string element extending transversely between the side walls of the frame member. Preferably, the tube-like polymer shooting string element extends through the frame member and is tied off. If the web is an open weave cross lacing, then the invention preferably includes at least one flexible, tube-like polymer thong element extending longitudinally between the scoop and stop of the frame member. The tube-like polymer thong element or the material it houses extends through the frame member and is tied off.

Figure 1A:
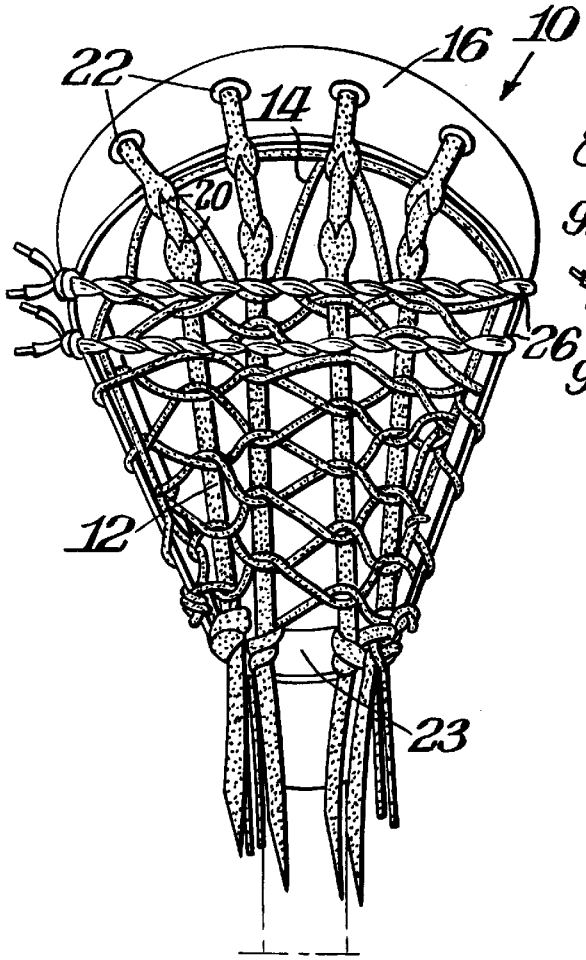
Fig. 1A. (Prior Art)
FIG. 1A is a front elevational view of a lacrosse stick head having conventional shooting string elements, conventional thong elements, and an open weave cross lacing.
Figure 2:
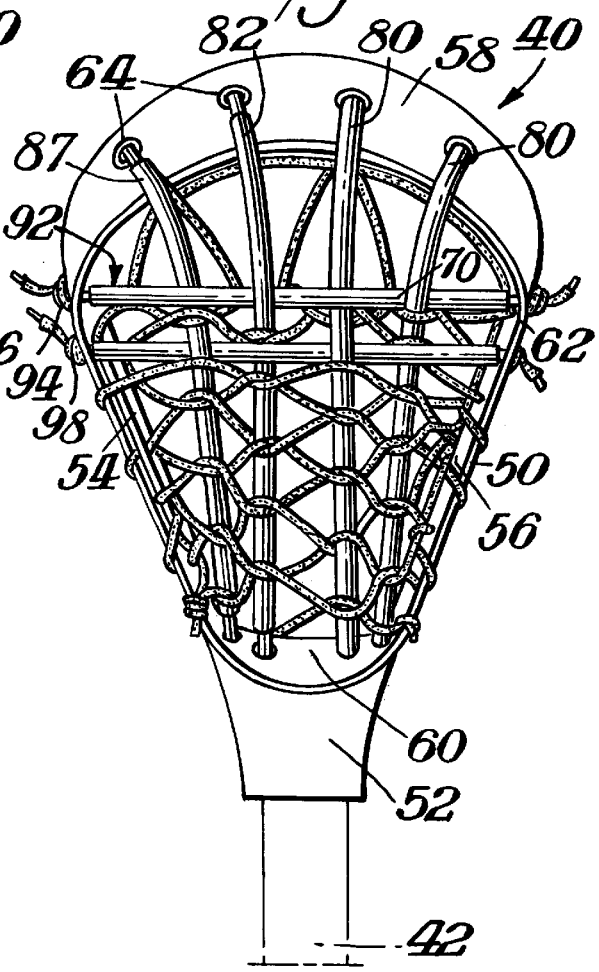
FIG. 2 is a front elevational view of a lacrosse stick head having an open weave cross lacing, and tube-like polymer shooting string and thong elements in accordance with the preferred embodiments of the present invention.

More particularly, as embodied herein and as shown in FIG. 2, a lacrosse stick 40 comprises a handle 42 shown in phantom lines and broken away, and a synthetic head 50. Head 50 comprises an integral, generally V-shaped frame having a juncture 52, sidewalls 54 and 56, a transverse wall or scoop 58 joining sidewalls 54, 56 at a distal end of head 50, and an end wall or a stop 60 joining sidewalls 54,56 at a proximal end of head 50. Handle 42 fits into and through juncture 52 and abuts stop 60. Preferably, a plurality of string holes 62 are formed in sidewalls 54, 56, and a plurality of string holes 64 are formed in scoop 58. Scoop 58 need not have string holes 64, but may contain protrusions known in the art as "tabs" in place of holes 64. Stop 60 also preferably has a plurality of string holes provided therein.

In accordance with a preferred embodiment of the present invention, lacrosse stick 40 further includes a stringing assembly unit comprising an open weave cross lacing 70 of string-like material extending transversely between side walls 54,56 of the frame of head 50 and being coupled directly to the frame member of head 50 or via sidestrings. The stringing assembly unit further comprises a plurality of tube-like polymer thong elements 80,82,87 extending longitudinally along the length of the frame of head 50. Each polymer thong element 80, 82, 87 or the material it houses may be connected to scoop 58, via a corresponding opening 64, and to stop 60 in a conventional manner.

Tube-like polymer thong elements 80, 82, 87 are substantially parallel throughout the longitudinal length of the frame member of head 50 and are spaced apart to provide a tracking area for movement of the lacrosse ball in head 50. Although four tube-like polymer thong elements 80, 82, 87 are shown in FIG. 2, the lacrosse stick head may comprise as few as two tube-like polymer thong elements or more than four tube-like polymer thong elements.

The tube-like polymer thong elements of the present invention preferably comprise one of five types of configurations. In a first configuration, the tube-like polymer thong element 82 comprise a tube 86 made of rubber, urethane or some other non-woven synthetic or natural polymer and having varying shapes (e.g. cylindrical, square, rectangular, triangular, polygonal) and constructions (e.g. segmented, spiraled, straight, open, slit) through which traditional string-like material 84 is fed. Traditional string-like material 84 is fed through tube 86 until such material 84, which may be ornamentally designed and exposed through a transparent or translucent tube 86, extends outside the tube ends and through the frame of the lacrosse head for use in tightening, or adjusting thong elements 82 and shaping a desired pocket.

In a second configuration, the tube-like polymer thong elements 87 comprise a tube 89 made of rubber, urethane or some other non-woven synthetic or natural polymer and having varying shapes (e.g. cylindrical, square, rectangular, triangular, polygonal) and constructions (e.g. segmented, spiraled, straight, open, slit) through which a second non-woven synthetic or natural polymer material 88 is fed until such material 88 extends outside the tube ends and through the frame of the lacrosse head for use in tightening, loosening or adjusting thong elements 87 and shaping a desired pocket.

In a third configuration, the polymer thong elements 80 comprise a flexible cord made from rubber, urethane or some other non-woven synthetic or natural polymer of solid construction (even if segmented, spiraled or split) and having varying shapes (e.g. cylindrical, square, rectangular, triangular, polygonal) that extends through the frame of the lacrosse head for use in tightening, loosening or adjusting the thong elements and shaping a desired pocket.

In a fourth configuration, the tube-like polymer thong elements comprise a tube made of nylon or some other woven synthetic or natural polymer and having varying shapes (e.g. cylindrical, square, rectangular, triangular, polygonal) and constructions (e.g. segmented, spiraled, straight, open, slit) through which a second woven synthetic or natural polymer material is fed until such material extends outside the tube ends and through the frame of the lacrosse head for use in tightening, loosening or adjusting thong elements and shaping a desired pocket.

In a fifth configuration, the polymer thong elements comprise a tube made of rubber, urethane or some other non-woven synthetic or natural polymer o r of nylon or some other woven synthetic or natural polymer and having varying shapes (e.g. cylindrical, square, rectangular, triangular, polygonal) and open construction (even if segmented, spiraled or split) which are tied off inside the frame or extend through the frame of the lacrosse head for use in tightening, loosening or adjusting the thong elements and shaping a desired pocket.

The stringing assembly unit further preferably comprises a plurality of tube-like polymer shooting string elements (or throw strings) 90, 98, providing extra support to the upper portion of the pocket. Tube-like polymer shooting string elements 90, 98 extend transversely along the width of the frame member, and are connected to side walls 54, 56, via openings in side walls 54, 56, or are tied off adjacent to and inside the side wall(s) of the frame member.

Tube-like polymer shooting string elements 90, 98 may be substantially parallel throughout the width of the frame member of head 50 and may be spaced apart or in close proximity. Although two tube-like polymer shooting string elements 90, 98 are shown in FIG. 2, the lacrosse stick head may comprise any number of tube-like polymer shooting string elements, depending upon a player's preference for influencing the release of a thrown ball.

The polymer shooting string elements of the present invention preferably comprise one of the five types of configurations shown above for the polymer thong elements. For ease of reference, FIG. 2 shows only the first and third configurations. In the first configuration, the polymer shooting string elements 90 comprise a tube 92 made of rubber, urethane or some other non-woven synthetic or natural polymer and having varying shapes (e.g. cylindrical, square, rectangular, triangular, polygonal) and constructions (e.g. segmented, spiraled, straight, solid, open, slit) through which traditional string-like material 94 is fed. The third configuration comprises polymer shooting string elements 98 made from a flexible polymer cord like the third configuration of the polymer thong elements.

Figure 4A:
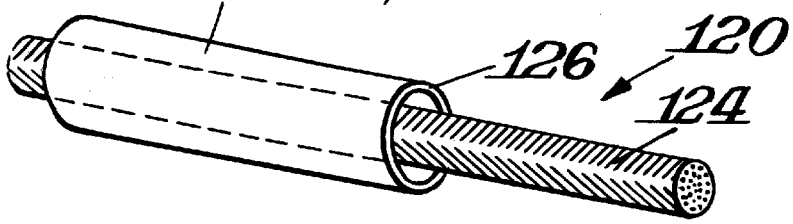
FIG. 4A is an exploded orthogonal view of a first configuration of the tube-like polymer shooting string and thong elements of the present invention.

FIG. 4A shows an exploded orthogonal view of the first configuration of the polymer shooting string and thong elements of the present invention, as reference numeral 120. In the first configuration, polymer thong or shooting string elements 120 comprise a flexible tube 122 made of urethane or some other non-woven polymer and having varying shapes (e.g. cylindrical, square, rectangular, triangular, polygonal, although FIG. 4A shows the cylindrical shape for exemplary purposes) and constructions (e.g. segmented, spiraled, straight, open, slit) through which a traditional string-like material 124 is fed. Traditional string-like material 124 is fed through tube 122 until such material 124, which may be ornamentally designed and exposed through a transparent or translucent tube 122, extends outside ends 126 of tube 122.

Figure 4B:
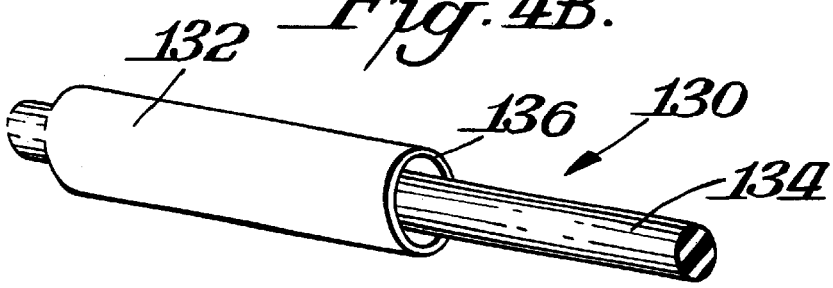
FIG. 4B is an exploded orthogonal view of a second configuration of the tube-like polymer shooting string and thong elements of the present invention.

FIG. 4B shows an exploded orthogonal view of the second configuration of the polymer shooting string and thong elements of the present invention, as reference numeral 130. In the second configuration, polymer thong or shooting string elements 130 comprise a flexible tube 132 made of urethane or some other non-woven polymer and having varying shapes (e.g. cylindrical, square, rectangular, triangular, polygonal, although FIG. 4B shows the cylindrical shape for exemplary purposes) and constructions (e.g. segmented, spiraled, straight, open, slit) through which a second non-woven polymer material 134 is fed until such material 134 extends outside ends 136 of tube 132.

Figure 4C:
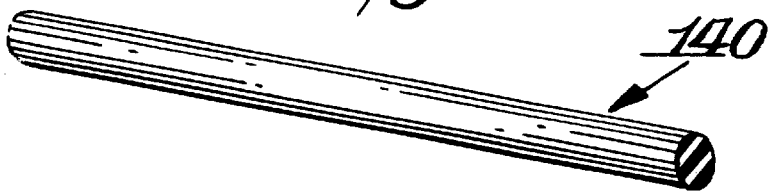
FIG. 4C is an exploded orthogonal view of a third configuration of the polymer cord shooting string and thong elements of the present invention.

FIG. 4C shows an exploded orthogonal view of the third configuration of the polymer shooting string and thong elements of the present invention, as reference numeral 140. In the third configuration, polymer shooting string elements 140 comprise a flexible polymer cord made from rubber, urethane or some other non-woven synthetic or natural polymer of solid construction and having varying shapes (e.g. cylindrical, square, rectangular, triangular, polygonal).

Figure 4D:
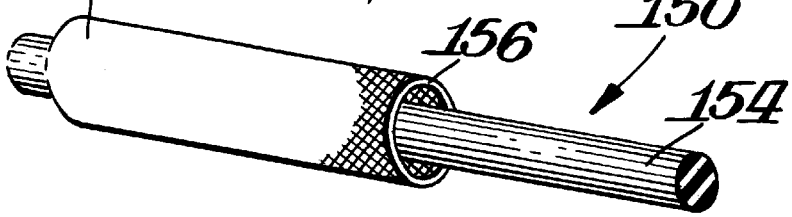
FIG. 4D is an exploded orthogonal view of a fourth configuration of the tube-like polymer shooting string and thong elements of the present invention.

FIG. 4D shows an exploded orthogonal view of the fourth configuration of the polymer shooting string and thong elements of the present invention, as reference number 150. In the fourth configuration, polymer thong or shooting string elements 150 comprise a flexible tube 152 made of a woven polymer and having varying shapes (e.g. cylindrical, square, rectangular, triangular, polygonal, although FIG. 4D shows the cylindrical shape for exemplary purposes) and constructions (e.g. segmented, spiraled, straight, open, slit) through which a second woven polymer material 154 is fed until such material 154 extends outside ends 156 of tube 152.

Figure 4E:
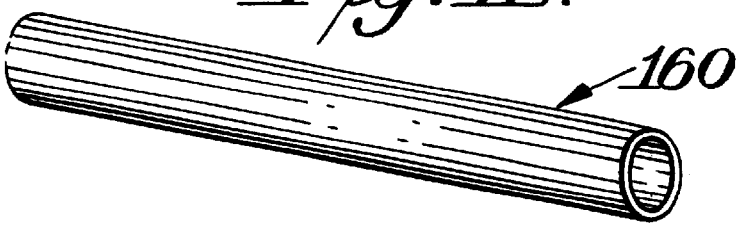
FIG. 4E is an exploded orthogonal view of a fifth configuration of the tube-like polymer shooting string and thong elements of the present invention.

FIG. 4E shows an exploded orthogonal view of the fifth configuration of the polymer shooting string and thong elements of the present invention, as reference numeral 160. In the fifth configuration, polymer thong or shooting string elements 160 comprise a flexible tube made of urethane or some other non-woven polymer and having varying shapes (e.g. cylindrical, square, rectangular, triangular, polygonal, although FIG. 4E shows the cylindrical shape for exemplary purposes) and constructions (e.g. segmented, spiraled, straight, open, slit). Flexible tube may also be transparent or translucent, and may be made from any color.

The non-woven polymer material of the present invention is a waterproof material having specified and variable stretching characteristics. Since the material is waterproof, it eliminates the problems experienced by conventional leather thong and woven shooting string elements, such as rotting, breaking, cracking, wearing, absorbing water, and unwanted stretching. The non-woven or woven polymer material also prevents open weave cross lacing from sliding out of place, ensuring a uniform pocket area.

In the most preferred embodiment of the present invention, the non-woven or woven synthetic or natural polymer used in the thong and shooting string elements comprises polyurethane tubing manufactured by Stevens Urethane of Holyoke, Mass. Stevens polyurethane tubing has, inter alia, the following properties: tensile strength up to 8,000 psi; outstanding tear strength; high burst strength; withstands millions of flexes without significant loss of properties; withstands continued exposure to temperatures from −65° F. to 220° F. (−54° C. to 104° C.) without deterioration; abrasion resistance; and high resistance to most other chemicals.

Traditional leather thong elements and woven shooting string elements exhibit varied and random stretching characteristics until they are worn out through use. In contrast, the flexible, tube-like polymer thong and shooting string elements of the present invention may have controlled and predictable stretching characteristics that are unaffected by use. Controlled stretching properties allow for a more shock-absorbing and softer pocket area for receiving a thrown ball, and more trampoline-like effect (greater velocity) when a ball is thrown from the lacrosse stick.

The polymer thong elements of the present invention can be easily made wider than conventional thong elements having a width 0.25 inches. Accordingly, in a four thong element assembly, the two outside thong elements may be wider or thinner than the two inside thong elements, creating more of a channel for the ball in the pocket. The polymer thong elements of the present invention are extremely lightweight, each weighing approximately 0.5 grams less than conventional leather thong elements when dry, and, in a four thong element assembly, approximately 1.35 ounces less than four saturated leather thongs.

Figure 3:
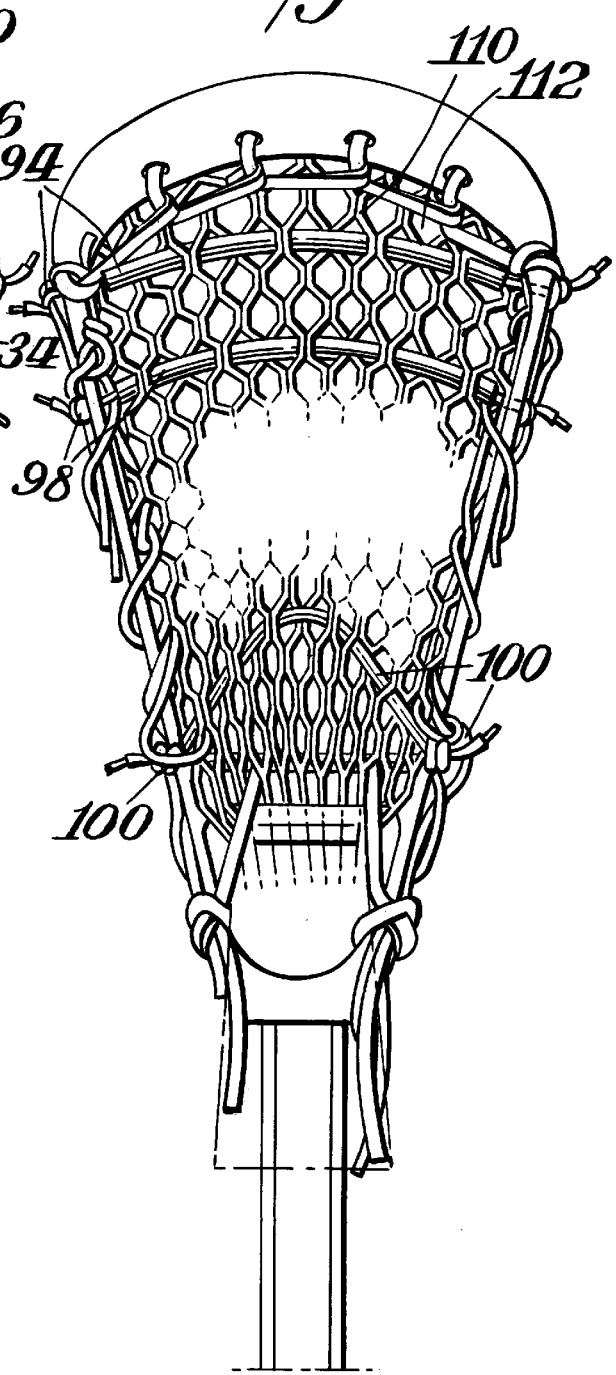
FIG. 3 is a front elevational view of a lacrosse stick head having a mesh web configuration and polymer shooting string elements extending transversely along the width of the head adjacent the scoop and in an arc-like shape midway in the head in accordance with the preferred embodiments of the present invention.

The polymer shooting string and thong elements of the present invention have a coefficient of friction greater than traditional shooting string and thong elements. This allows for improved ball handling, control and feel, and prevents the open weave cross lacing from sliding out of place, ensuring a uniform pocket area. These advantages can be enhanced by creating rough, abraded, and irregular surfaces on the shooting string and thong elements of the present invention. will be apparent to those skilled in the art that various modifications and variations can be made in the polymer shooting string and thong elements of the present invention and in construction of these shooting string and thong elements without departing from the scope or spirit of the invention. As an example and as shown in FIG. 3, the shooting string elements of the present invention may be used with a mesh configuration 110 that employs a mesh knitted as a continuous strip of woven material having a plurality of openings provided 112 therein. Any of the five configurations of the polymer shooting string elements may be used with the mesh configuration, although FIG. 3 shows only the first and second types of tube-like polymer shooting string elements 90, 98. Furthermore, any of the five configurations of the polymer shooting string elements may be used with a conventional central mesh utilizing an open weave lacing along the frame.

As another example of a modification, the tube-like polymer shooting string elements of the present invention need not extend transversely along the width of the frame member. Rather, as shown in FIG. 3, polymer shooting string elements 100 may extend along the width of the frame member near the center portion of the web in an arcuate or upside down V- or U-shape, enhancing pocket formation and ball location, and creating a channeling-like effect when the ball is cradled, carried or thrown. The polymer shooting string elements may extend through the frame member and be tied off or be tied around the side string in a mesh configuration or the open weave lacing in a traditionally strung head.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A head for a lacrosse stick, comprising:

a frame member having first and second side walls, each of the side walls having a proximal end and a distal end, the frame member further having a scoop extending between the distal ends of the side walls, and a stop extending between the proximal ends of the side walls;

a web for receiving a ball, the web being attached to the frame member; and one or more elements interwoven with the web, each of the one or more elements having a string-like woven polymer material substantially within and moveable through a non-woven polymer tubing, wherein the one or more elements extend transversely within the frame member, and each string-like woven polymer material is longer than its corresponding non-woven polymer tubing to provide for tightening and loosening of each string-like woven polymer material and adjustment to sections of the web where the one or elements are interwoven with the web.

2. A head for a lacrosse stick as recited in claim 1, wherein each of the one or more elements extends through the frame member and is tied off.

3. A head for a lacrosse stick as recited in claim 1, wherein each of the one or more elements is tied off to the web, inside the frame member.

4. A head for a lacrosse stick as recited in claim 1, wherein the one or more elements extend in the upper section of the web below the scoop.

5. A head for a lacrosse stick as recited in claim 1, wherein the one or more elements extend transversely within the frame member in one of an arcuate, angled, or non-linear shape.

6. A head for a lacrosse stick as recited in claim 1, wherein a portion of each string-like woven polymer material of each of the one or more elements extends through the frame member and is tied off.

7. A head for a lacrosse stick as recited in claim 1, wherein a portion of each string-like woven polymer material of each of the one or more elements is tied off to the web inside the frame member.

8. A head for a lacrosse stick as recited in claim 1, wherein each non-woven polymer tubing of each of the one or more elements is flexible to permit adjustment of the web.

* * * * *